United States Patent [19]

Methot

[11] Patent Number: 4,601,073

[45] Date of Patent: Jul. 22, 1986

[54] SWIMMING POOL COPING SYSTEM

[76] Inventor: Donald E. Methot, 77F Glenpark Dr., Gloucester, Ontario, Canada, K1B 3Z1

[21] Appl. No.: 729,098

[22] Filed: May 3, 1985

Related U.S. Application Data

[63] Continuation of Ser. No. 502,914, Jun. 10, 1983, abandoned.

[30] Foreign Application Priority Data

Jun. 23, 1982 [CA] Canada ..... 405802

[51] Int. Cl.[4] ..... E04H 3/18

[52] U.S. Cl. ..... 4/506; 52/300

[58] Field of Search ..... 4/506, 510; 52/169.7, 52/300

[56] References Cited

U.S. PATENT DOCUMENTS

| | | | |
|---|---|---|---|
| D. 193,055 | 6/1962 | Lamb . | |
| D. 247,579 | 3/1978 | Laven . | |
| D. 248,778 | 8/1978 | Kaufmann . | |
| D. 258,537 | 3/1981 | Cribben et al. . | |
| D. 258,538 | 3/1981 | Cribben et al. . | |
| D. 258,618 | 3/1981 | Cribben et al. . | |
| 3,072,921 | 1/1963 | Hegerfeld . | |
| 3,236,012 | 2/1966 | Laven . | |
| 3,310,814 | 3/1967 | Lipman . | |
| 3,347,006 | 10/1967 | Fox | 52/300 |
| 3,416,165 | 12/1968 | Pereira . | |
| 3,427,663 | 2/1969 | O'Connell et al. . | |
| 3,440,780 | 4/1969 | Adam et al. . | |
| 3,500,605 | 3/1970 | Katzman . | |
| 3,512,326 | 5/1970 | Greene . | |
| 3,546,720 | 12/1970 | Hoch et al. . | |
| 3,628,198 | 12/1971 | Katzman | 4/506 |
| 3,641,595 | 2/1972 | Viessmann . | |
| 3,667,071 | 6/1972 | Hoch et al. . | |
| 3,785,099 | 1/1974 | Greene . | |
| 3,797,049 | 3/1974 | De Santo . | |
| 3,811,236 | 5/1974 | Fiddes . | |
| 3,835,481 | 9/1974 | Englelhart et al. . | |
| 3,938,199 | 2/1976 | Laven . | |
| 4,048,773 | 9/1977 | Laven . | |
| 4,084,272 | 4/1978 | Laven . | |
| 4,115,977 | 9/1978 | Bertsch . | |
| 4,124,907 | 11/1978 | Laven . | |
| 4,151,691 | 5/1979 | Wendt . | |
| 4,167,084 | 9/1979 | Brunton . | |
| 4,229,844 | 10/1980 | Cribben . | |
| 4,335,474 | 6/1982 | Bailey | 4/506 |

*Primary Examiner*—Charles E. Phillips

*Attorney, Agent, or Firm*—Jones, Tullar & Cooper

[57] ABSTRACT

The present invention relates to vinyl lined swimming pool copings and provides an aluminum sub-coping of the concrete receptor type in combination with a fully supported PVC snap-cap which is secured in place over what would otherwise be an exposed surface of the aluminum sub-coping, utilizing special locking grooves in the sub-coping. As well, the PVC snap-cap can be provided with a built-in bead cover and/or bead retainer. Using appropriate tooling, the aluminum sub-coping of the present invention can be shaped to permit it to be installed on curved shaped pools.

2 Claims, 5 Drawing Figures

SWIMMING POOL COPING SYSTEM

This application is a continuation of application Ser. No. 502,914, filed June 10, 1983, now abandoned.

BACKGROUND OF THE INVENTION

This invention relates in general to vinyl lined swimming pools and more specifically to a vinyl lined swimming pool coping system which extends about the periphery of the upper edge of a pool. More specifically, this invention pertains to a bullnose or concrete receptor type of swimming pool coping.

Bullnose or concrete receptor type copings are used when the deck for the pool is to be formed of concrete which is fast becoming one of the most frequently used types of swimming pool decks because of its many advantages.

In the past, bullnose or concrete receptor types of copings have been constructed of either extruded polyvinyl chloride (PVC) or extruded aluminium. There are many known examples such as those shown in U.S. Pat. Nos. 3,500,605; 3,546,720; 3,641,595; 3,811,236; 3,835,481; 3,938,199; 4,115,977; 4,124,907; and 4,167,084.

Of the two types of concrete receptor copings in wide-spread commercial use, PVC is sost widely used for a number of reasons. The advantages of PVC include the fact that it is more economical than aluminum. Also, unlike aluminum, it requires no painting and cannot be scratched or dented readily while being moved, stored or handled. Also because of its flexibility, it can be made to fit on radius (curved) panels used for forming kidney, and oval, shaped pools. The disadvantages of PVC include UV (ultraviolet light) degradation. Also the harsh freeze-thaw cycles experienced over much of the North American continent as well as other parts of the world, can have a devasting effect on PVC coping, causing it to yellow and possibly fail through cracking and breakage. When this happens, the cost of the coping itself is relatively minor, as the coping has a relatively low cost per linear foot, but the consequential damages arising from such a failure can be quite substantial.

To repair a damaged PVC coping, one must first drain the pool water which has normally been treated with expensive chemicals. Also the cost of the water required to fill a swimming pool in some rural areas can be very high because the water has to be trucked in. The next step is to remove the broken PVC coping which cannot be done until a section of the concrete decking approximately 1' wide about the periphery of the pool is broken with a jack-hammer and removed manually. At this stage the new coping is installed and the temporarily exposed bottom of the swimming pool must be touched up and cleaned thoroughly prior to the reinstallation of the vinyl liner providing that over the years the vinyl liner has not shrunk to the point where it is no longer possible to reinstall it. Should this shrinkage occur then the added expense of a new liner must be added to the expense of replacing the PVC coping.

Once the new coping has been installed and the vinyl liner hooked back into the new coping, the pool is ready for refilling. Then the final stage is to repair the concrete deck surrounding the pool. Simply adding new concrete between the newly installed coping and that portion of the concrete deck left unbroken can, and in most cases does, lead to adhesion problems between the old and new concrete. Therefore an expansion joint is normally used between the "old" and the "new" decks to eliminate this problem.

The final result of this repair is a two-tone deck consisting of new cement and weathered cement with an expansion joint separating the two. This is not asthetically acceptable to many people. Furthermore, the pool owner runs the risk of having the untouched or original portion of his concrete deck sink from lack of support due to the fact that under some circumstances the original concrete deck would have provided a bridge between the pool coping and the relatively compacted back-fill located the width of the coping back from the edge of the pool.

It will be appreciated that costs of this repair can be substantial and if costs are hindered by high water tables, a shrunken liner or problems with the weather, the costs can easily double or even triple under some circumstances.

Also in use are extruded aluminum concrete receptor copings. This type of coping is used by many manufacturers and pool builders because of the fact that it enables the vinyl pool liner to be held in position in a groove by a metal part which is generally less susceptible to breaking than plastic (PVC).

However aluminum concrete receptor copings have disadvantages. These include the fact that expensive packaging is required for these copings to protect their painted surfaces during the handling required for freighting and for storage. Also, once installed, this coping may require repainting on site due to scratches and nicks incurred in it over a period of time. Invariably, the resultant repainted surface will peel in a relatively short period of time. Also, the use of this type of coping on shaped pools such as those having a kidney-shape, oval-shape or round-shape is difficult if not impossible due to the necessity of forming a curve in the coping which usually resuts in the forming of an unacceptabe kink in the coping.

It is also known to employ a liner bead cover and/or a liner lock. This item can be installed when the pool is initially installed or the item can be retrofitted as a companion part to most types of copings no matter whether formed of aluminum or PVC. The function of a liner bead cover and liner lock is twofold. It locks the liner into place and prevents the bead (that portion of the vinyl liner which hooks into the coping) from popping out of its locked-in position which sometimes happens when the liner bead is not properly installed in its receptive groove. Bead cover or liner lock is only available in extruded PVC. The other function of a bead cover is to protect the soft flexible PVC bead against the ravages of UV exposure which may cause degradation leading to eventual failure of the bead. It does this simply by covering or shielding the bead portion of the liner from direct sunlight.

SUMMARY OF THE INVENTION

The present invention overcomes many of the above noted disadvantages of the prior art structures, no matter whether those structures are formed from aluminum or PVC.

More specifically, the present invention provides a sub-coping of the concrete receptor type in combination with a fully supported PVC snap-cap which is secured in place over what would otherwise be an exposed surface of the sub-coping, preferably by utilizing special locking grooves in the sub-coping. The coping is preferably formed from extruded aluminum but can be extruded plastic. As well, the PVC snap-cap can be provided with a built-in bead cover and/or bead retainer. Using appropriate tooling, the sub-coping of the present invention, even if formed from aluminum, can be shaped to permit it to be installed on curved shaped pools.

Consequently in accordance with its broadest aspect, this invention relates to a sub-coping for concrete decked swimming pools comprising an extruded coping for vinyl lined swimming pools having a deck, said coping being provided with means for locating it about the upper edge of a pool to form the pool side edge of a deck, a bead retaining groove in said coping and means on said coping for removably retaining a cap in a position to cover substantially that portion of the coping otherwise normally exposed to view.

The invention also includes the cap cooperable with the coping.

DETAILED DESCRIPTION OF THE PREFERRED EMBODIMENTS

Figure 1:
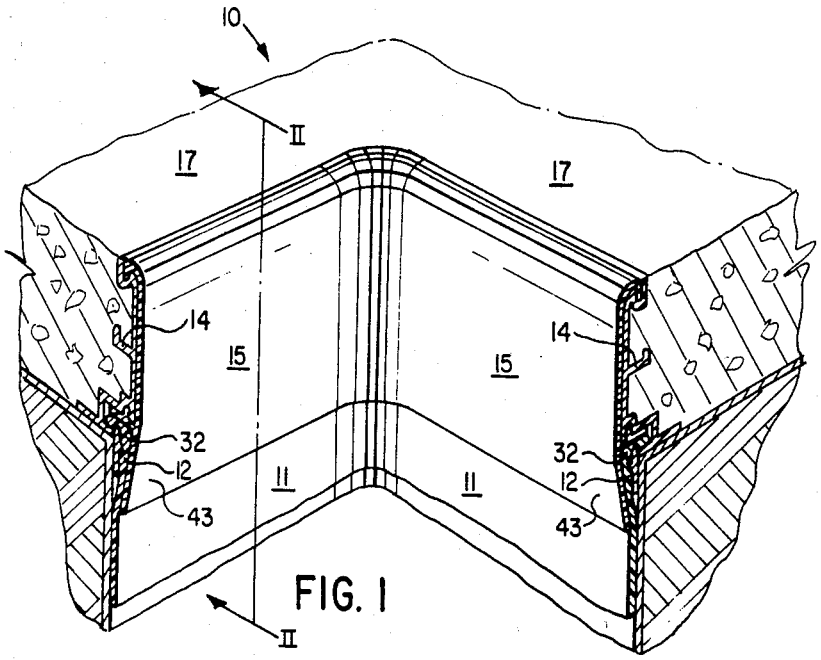
FIG. 1 is a perspective view of a section of a corner having a 6" radius of a swimming pool which is provided with an aluminum, concrete receptor sub-coping and a PVC snap-cap of the present invention.

Referring now to the drawings and in particular to FIG. 1 there is shown a corner of a swimming pool 10 which includes a conventional PVC liner 11, the periphery 12 of which is retained by means of a liner retainer bead 32 in a coping 14 covered by a PVC snap-cap 15. A concrete deck 17 extends back from the coping 14. The deck could be other than concrete, such as one formed of wood.

Figure 2:
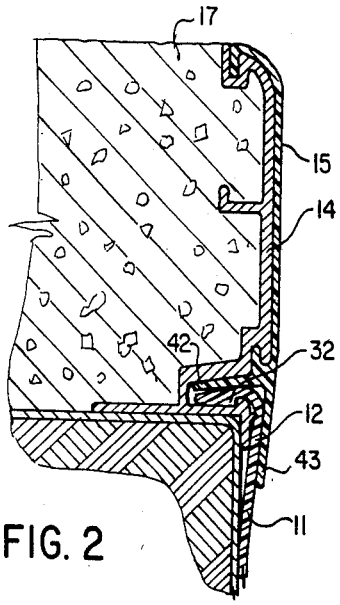
FIG. 2 is a section taken along the lines 2—2 of FIG. 1.
Figure 4:
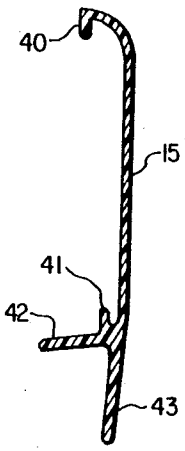
FIG. 4 is a preferred form of snap-cap which can be utilized in the present invention.
Figure 3:
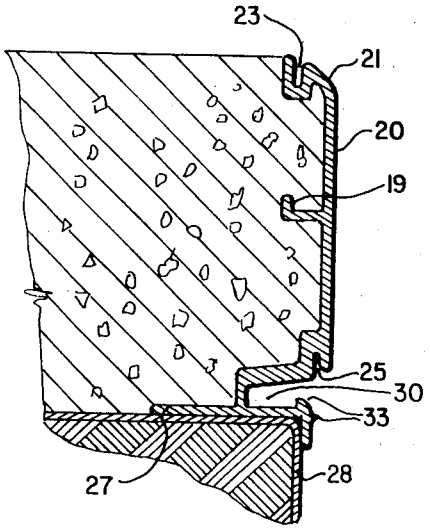
FIG. 3 is the same as FIG. 2 with the snap-cap and liner retainer bead removed.

In FIGS. 2, 3 and 4 the coping 14, extruded from aluminum alloy in a conventional manner, includes, as best seen in FIG. 3, a vertical face member 20 which curves inwardly at its upper edge 21 and terminates with an upper, snap-cap retaining groove 23. An "L" shaped member 19 extends back from the rear side of face member 20 to aid in locking the coping into the concrete deck 17. The member 19 could be replaced with a flat lip to which a wooden plank could be secured.

A lower snap-cap retaining groove 25 is formed at the bottom edge of the face member 20. The coping then extends inwardly, and downwardly to a horizontal support plate 27 to define a liner bead retaining groove 30 conventionally shaped to receive a conventional bead 32 in a conventional manner. Support plate 27 is secured by self-tapping screws (not shown and conventional) to the top edge 28 of the pool's wall. The liner bead 32, which extends about the entire periphery of the liner 11 as known, is retained in the groove 30, as is conventional, by a pair of ears 33, that ear which is projecting upwardly engaging the edge of the bead and that ear which is projecting horizontally outwardly embedding itself slightly into the bead as shown in FIG. 2.

Figure 5:
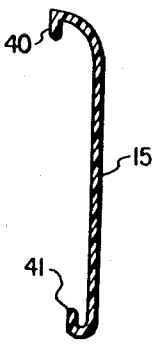
FIG. 5 is an alternate form of snap-cap for use in the present invention.

For asthetic reasons, and also to provide the preferred bead protector and retainer, a snap-cap 15 fits over the face member 20 as best shown in FIG. 2. FIGS. 4 and 5 illustrate the snap-cap 15 which includes an upper tongue 40 which snaps into the upper snap-cap retaining groove 23 in the coping and a lower tongue 41 which fits into the lower snap-cap retaining groove 25 in the coping. The snap cap is extruded from PVC material. Optionally as in FIG. 4, the snap-cap can also be provided with a bead retaining arm 42 and also optionally with a bead protecting leg 43. Reference to FIG. 2 shows the bead retaining arm 42 jamming the bead 32 against the upwardly projecting ear 33 and the bead protecting leg 43 lying over the top of the bead to protect it from ultra-violet light.

As shown in FIG. 5, the snap-cap need not include either the bead retaining arm 42 or the bead protecting leg 43, either or both of which are optional, although to be preferred under most circumstances.

It will be appreciated that there is provided by this invention a coping system which utilizes a sub-coping permanently secured to the pool side edge of a deck, preferably a concrete deck. In the embodiment shown, the coping serves as a form to retain the wet concrete when poured and on drying the coping is locked into the edge of the concrete deck. Alternately the coping could be shaped to be secured by fasteners to a flat side wall of the deck. The coping could be extruded from a plastic and could be formed as a part of the pool wall. Overlying that sub-coping is a removable snap-cap which can be replaced when required for asthetic reasons, at little expense and with no damage to the concrete deck. The snap-cap could be secured with an adhesive as opposed to the use of a mechanical interlock between the coping and cap. The coping of the present invention includes the required, conventional bead retaining groove and the snap-cap of the invention can include if required a bead retaining arm and a bead protecting leg with the result being a very effective, simple and asthetically pleasing coping which presents to the viewer a clean, smooth, appropriately coloured, PVC snap-cap which extends over both the coping and the upper edge of the pool's liner and its retaining bead.

I claim:

1. A unitary, bead-retaining coping for a vinyl-lined swimming pool having a deck, including:

a sub-coping adapted to be permanently secured to the pool side edge of a swimming pool deck, said sub-coping having an outer vertical face portion, said outer vertical face portion having an upper, inwardly extending element adapted to engage and secure said sub-coping to the top of said deck, said inwardly extending element incorporating an upwardly facing cap-retaining groove;

an intermediate, inwardly extending locking member on said sub-coping below said upper, inwardly extending element and adapted to further secure said sub-coping to said deck;

a lower, inwardly extending portion formed in said vertical face portion of said sub-coping, and forming the upper wall of a bead-retaining groove;

an inwardly extending, horizontal base plate unitarily formed with said lower, inwardly extending portion of said vertical face portion of said sub-coping and forming a lower wall of said bead-retaining groove, said upper and lower walls cooperating to define an inwardly extending liner bead retaining groove, said base plate being adapted to engage the top edge of a pool below its deck;

first and second projections extending upwardly and outwardly, respectively, from said sub-coping base plate and adapted to engage and secure a liner bead of a vinyl swimming pool liner in said retaining groove; and a removable cap for said sub-coping, said cap including a vertical cover member carrying at its upper edge a downwardly extending tongue portion for engaging said upwardly facing cap-retaining groove, and including at its lower portion a downwardly extending bead protection leg and an inwardly extending bead-engaging arm, said inwardly extending bead-engaging arm adapted to extend into said liner bead retaining groove in contact with the upper wall thereof for engaging and securing said liner bead against said lower wall and against at least one of said first and second projections, said cap means being removably attachable to said sub-coping to secure said vinyl pool liner to the top edge of a pool below its deck and to protect the upper bead edge of said liner, said tongue means and said bead-retaining arm cooperating to hold said vertical cover member of said removable cap securely against said vertical face portion of said sub-coping to prevent entry of water therebetween and to hold said downwardly extending bead protection leg securely against a vinyl pool liner to thereby protect the upper edge thereof.

2. The coping of claim 1, wherein said coping is extruded, and is shaped to provide a pouring form for a concrete swimming pool deck.

* * * * *